United States Patent [19]

Godec et al.

[11] Patent Number: 4,466,643

[45] Date of Patent: Aug. 21, 1984

[54] DOGGING DEVICE, METHOD OF FORMING THE SAME, AND AN ADAPTER KIT THEREFOR

[75] Inventors: Maksimilijan Godec; John R. Foster; Paul J. Straub, all of Indianapolis; Allan K. Mahler, Terre Haute, all of Ind.

[73] Assignee: Von Duprin, Inc., Indianapolis, Ind.

[21] Appl. No.: 289,756

[22] Filed: Aug. 3, 1981

[51] Int. Cl.[3] ..... E05C 19/02

[52] U.S. Cl. ..... 292/92; 292/336.3; 292/210

[58] Field of Search ..... 292/21, 92, 210, 1, 292/121, 128, DIG. 49, DIG. 62, 216, 224, 226, 124, 126, 169.22, 336.3; 70/380, DIG. 42

[56] References Cited

U.S. PATENT DOCUMENTS

| | | | |
|---|---|---|---|
| 2,924,474 | 2/1960 | Lange | 292/128 |
| 3,197,246 | 7/1965 | Russell et al. | 292/128 X |
| 3,374,021 | 3/1968 | Gulette | 292/DIG. 62 |
| 3,614,145 | 10/1971 | Zawadyki | 292/201 X |

*Primary Examiner*—Richard E. Moore
*Attorney, Agent, or Firm*—B. J. Murphy

[57] ABSTRACT

The dogging device comprises a detented dogging hook, for engaging a latching and unlatching control rod of a panic exit latch and actuator assembly, or a like assembly, and comprises means for selectively changing the operator-implements thereof from one type to another. The method comprises the steps of forming such a changeable dogging device. The kit sets forth the components parts cooperative with a basic dogging device for adapting the latter for use with any one of a plurality of operator-implements.

12 Claims, 5 Drawing Figures

DOGGING DEVICE, METHOD OF FORMING THE SAME, AND AN ADAPTER KIT THEREFOR

This invention pertains to dogging devices as are typically used with panic exit and actuator assemblies and, in particular, to a new dogging device which can accommodate a plurality of operator-implements, a method of forming the same, and an adapter kit for modifying a basic dogging device for acceptance of any one of a plurality of different operator-implements.

Dogging devices are well known in the prior art, as set forth, for instance, in U.S. Pat. No. 3,614,145, issued to George Z. Zawadzki, on Oct. 19, 1971, for a "Dogging Device for Panic Exit Latch and Actuator Assemblies". The patentee disclosed a number of dogging devices in different embodiments in his patent. One of the devices is operative by means of a screwdriver or hexagonal tool. Another of the dogging devices is operative by means of a mortise cylinder and key. Still a further dogging device, disclosed in the patent, comprises a solenoid electrically-operative to dog the panic exit latch.

It is customary in this art for panic exit latches, and the like, to be provided with any one of the dogging devices, of course. If it is desired to have a different dogging device, it is necessary to purchase and use a different, appropriately constructed panic exit latch. The dogging devices are not interchangeable from one latch assembly to another, so it is necessary to specify, at the time of latch assembly purchase, the kind of dogging device necessary or desired therein.

The panic exit latch assemblies are used, typically, in public buildings, schools, and the like and, frankly, there occurs some tampering, with the dogging devices therein, by unauthorized persons. If the dogging device is operative by means of a hexagonal tool, it will occur that unauthorized persons will use a screwdriver, or such, to release the dogging device. Alternatively, if the dogging device is key-operated, through a mortise cylinder, it will happen that the key becomes lost and the device cannot be released, or unauthorized copies of the key will be made to enable unauthorized persons to operate the device.

For the foregoing reasons, there has been a need for some facile means of changing dogging devices from operation by means of a given operator-implement (i.e., a key, tool, etc.) to another thereof at will. If this were possible, a key-operated dogging device could be easily changed for use with a hexagonal tool, and vice versa.

It is an object of this invention to meet the aforesaid need.

It is particularly an object of this invention to set forth a dogging device, for a latching assembly having a translating latching and unlatching control rod, comprising: first means defining a bearing surface; a shaft journaled on its axis in, and extending normal to, said bearing surface; second means, integral with said first means, having a recess formed therein in which to receive an end of a translating, latching and unlatching control rod; keeper means, pivotably mounted on said shaft, for movement between first and second pivotable positions relative to said shaft; wherein said keeper means has means, operative in one of said positions, for engaging an end of a translating latching and unlatching control rod for securing such end against withdrawal from said recess; further including detent means for restraining said keeper means, selectively, in either of said first or second positions; wherein said shaft and said keeper means have mutually engaged keying surfaces formed thereon for causing coincident rotation thereof; and also including operator means, slidably engaged with said keying surfaces of said shaft, for rotating said shaft to cause pivotable movement of said keeper means from either of said first and second positions to the other thereof.

It is another object of this invention to set forth a method of forming a latching assembly dogging device for differing operator-implements, comprising the steps of: providing a bearing surface; journalling a shaft on its axis in, and normal to, said bearing surface; fitting an apertured dogging hook circumjacent said shaft; forming mutually-engaging keying elements on said shaft and said dogging hook to cause coincident rotation thereof; and forming said shaft with axially-extended flat, walled surfaces for engaging therewith any one of a plurality of differing, flat-surfaced operator-implements.

It is a further object of this invention to set forth an adapter kit for a dogging device for a latching assembly having a translating latching and unlatching control rod; said device having, first means defining a bearing surface; a shaft journaled on its axis in, and extending normal to, said bearing surface; second means, integral with said first means, having a recess formed therein in which to receive an end of a translating, latching and unlatching control rod; keeper means, pivotably mounted on said shaft, for movement between first and second pivotable positions relative to said shaft; wherein said keeper means has means, operative in one of said positions, for engaging an end of a translating latching and unlatching control rod for securing such end against withdrawal from said recess; and further including detent means for restraining said keeper means, selectively, in either of said first or second positions; wherein said shaft and said keeper means have mutually engaged keying surfaces formed thereon for causing coincident rotation thereof; said adapter kit comprising: a plurality of operator-implements; wherein each of said operator-implements of said plurality thereof has keying surfaces for slidable engagement of the latter with said keying surfaces of said shaft, thereby to couple any one of said operator-implements operably to said shaft to enable rotation of said shaft by said one operator-implement.

Further objects of this invention, as well as the novel features thereof, will become more apparent by reference to the following description taken in conjunction with the accompanying figures in which.

Figure 1:
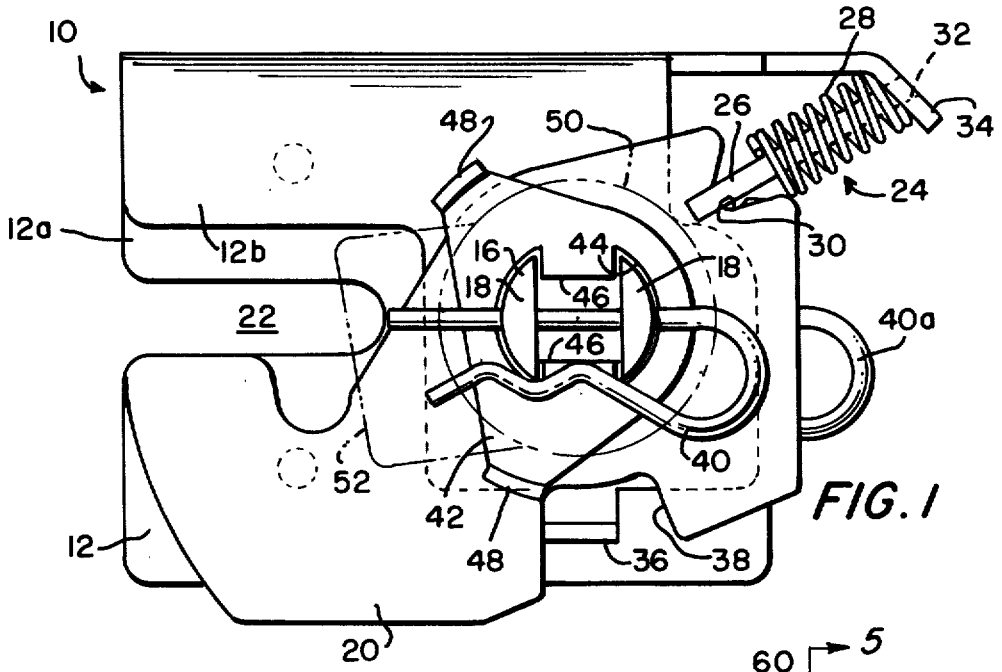
FIG. 1 is a side elevation of an embodiment of the dogging device according to the invention.
Figure 5:
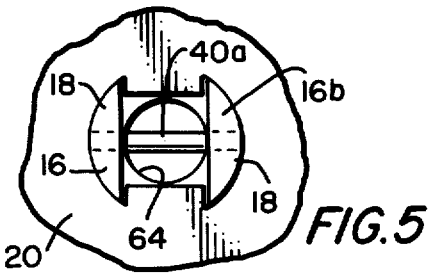
FIG. 5 is a cross-sectional view taken along section 5—5 of FIG. 4 (with the operator-implement and its coupling pin removed).
Figure 3:
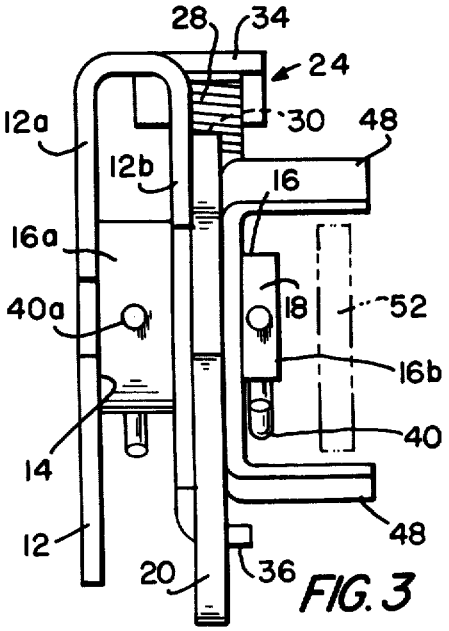
FIG. 3 is an end view of the dogging device of FIG. 1 taken from the left side of FIG. 1.

As shown in the figures, especially FIG. 1, the dogging device 10, according to an embodiment thereof comprises a base 12 which provides a bearing surface 14 (FIG. 3) for a shaft 16. The base 12 is generally U-shaped and accommodates therein the shaft 16, the same being journaled for rotation. The shaft is in traverse of both leaves 12*a* and 12*b* of the U-shaped base 12, and has a bifurcation 18. It receives thereabout a keeper or dogging hook 20 for engaging an end of a translating latching and unlatching control rod for a panic exit latch (or the like). The hook 20 and base 12 define a recess 22 into which the control rod end (not shown) may enter.

A detent arrangement 24, comprising a forked rod 26 and a biasing spring 28, comprises an off-center device maintaining the keeper or hook 20 in either of two alternative positions. forked end of the 26 engages a recess in one end of the keeper the other end of the rod 26 is constrained in a slot 32 formed in an extending wing 34 of the base 12. A tang 36 extending right-angularly from an edge of leaf 12*b* intrudes into a recess 38 formed in the keeper or dogging hook 20. The tang 36 serves as a limit stop halting the keeper or dogging hook 20 in optimum alternative positions. The shaft has a pin hole, formed through the limbs of the bifurcation 18, transverse to its axis, to receive a pin 40 therethrough. The shaft 16 is of two parts, a first, hollow stub 16*a*, and a second, hollow stub 16*b* slid into, and pinned, by pin 40*a*, securely thereto.

In a first embodiment, as shown in FIG. 1, the dogging device 10 receives a plate-type operator-implement 42 which has a central bore 44. The implement 42 has a pair of tabs 46 which protrude between the limbs of the bifurcation, and the center bore 44 receives the shaft 16 therethrough. The pin 40 fixes the plate implement 42 on the shaft, and the mutual engagement of the tabs 46 and limbs of the bifurcation 18 insure coincident rotation. The plate implement 42 has two upstanding limbs 48, set apart by one hundred and twenty degrees of arc, between which to receive the tongue of a lock cylinder. Shown in phantom, by means of dashed lines, are a lock cylinder 50, and the tongue 52 thereof, as such would be disposed for engaging the upstanding limbs 48 of the plate adapter.

When the plate-implement 42 is rotated in the clockwise direction, it will cause the keeper or dogging hook 20 to execute a same rotation and latch the end of a latching assembly control rod (within the recess 22 formed therefor). The end of the rod may be slotted, to receive the dogging hook end, or it may have a "T" or dog-leg end to be captured by the hook end. This is immaterial to the invention. The detent arrangement 24 will retain the keeper or dogging hook 20 in the clockwise, dogged position, unless and until the plate implement 42 is forceably turned in the counterclockwise direction to release the control rod.

Figure 4:
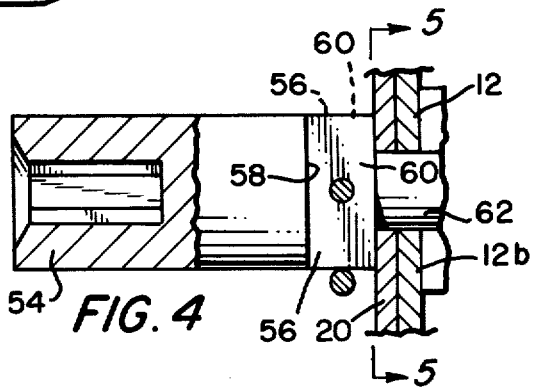
FIG. 4 is a cross-sectional view taken through section 4—4 of FIG. 2.
Figure 2:
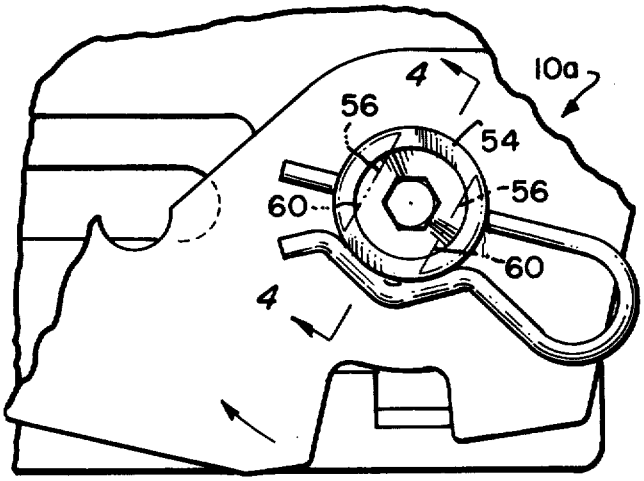
FIG. 2 is a side elevation of a portion of the FIG. 1 embodiment, modified with an alternative operator-implement, the same showing the keeper or dogging hook in an alternative position.

In FIGS. 2 and 4 is shown an alternative embodiment 10*a* of the novel dogging device, with the keeper or dogging hook 20 in the latched or dogged position. This embodiment accommodates a hexagonal-bored operator-implement rod 54. The rod 54 has a pair of recesses 56 on opposite sides which define shoulders 58 and flat walls 60. The walls 60 nestably engage the bifurcation 18 of the shaft 16, and the rod 54 is bored therethrough to accommodate the pin 40. The rod 54 has a small diameter, end pin 62 which is received in a like diameter hollow 64 of the stub 16*b*.

As can be appreciated, then, the plate-implement 42 can be replaced by the hexagonal-bored rod 54, and vice versa. It is only necessary to withdrawn the spring pin 40 to release the rod 54, or the plate-implement 42 and then replace it with the other.

To revert to U.S. Pat. No. 3,614,145, it comprises a housing enclosing the panic exit latch assembly having an end cover portion through which is formed a small hole for a hexagonal tool, to operate the dogging device, or in which is mounted a key-operated mortise cylinder—for dogging device operation. This invention comprehends the use of end covers which are removeable so that the end cover to be used will either have the small hole to accommodate a hexagonal tool, to operate the dogging device of FIGS. 2 and 4, or the end cover will be replaceable by one with a larger aperture, to accommodate therein the mortise lock or cylinder for key operation.

While we have described our invention in connection with specific embodiments thereof, it is to be clearly understood that this is done only by way of example, and not as a limitation to the scope of our invention as set forth in the objects thereof and in the appended claims.

We claim:

1. A dogging device, for latching assembly having a translating latching and unlatching control rod, comprising:

first means defining a bearing surface;

a shaft journaled on its axis in, and extending normal to, said bearing surface;

second means, integral with said first means, having a recess formed therein in which to receive an end of a translating, latching and unlatching control rod;

keeper means, pivotably mounted on said shaft, for movement between first and second pivotable positions relative to said axis; wherein said keeper means has means, operative in one of said positions, for engaging an end of a translating latching and unlatching control rod for securing such end against withdrawal from said recess; further including detent means for restraining said keeper means, selectively, in either of said first or second positions; wherein said shaft and said keeper means have mutually engaged keying surfaces formed thereon for causing coincident rotation thereof; and also including operator means, slidably engaged with said keying surfaces of said shaft, for rotating said shaft to cause pivotable movement of said keeper means from either of said first and second positions to the other thereof; wherein said operator comprises a plate; and said plate has a pair of upstanding limbs, the same being disposed for engagement by a rotatably tongue of a locking and unlocking device.

2. A dogging device, for a latching assembly having a translating latching and unlatching control rod, comprising first means defining a bearing surface;

a shaft journaled on its axis in, and extending normal to, said bearing surface:

second means, integral with said first means, having a recess formed therein in which to receive an end of a translating, latching and unlatching control rod;

keeper means, pivotably mounted on said shaft, for movement between first and second pivotable positions relative to said axis; wherein said keeper means has means, operative in one of said positions, for engaging an end of a translating latching and unlatching control rod for securing such end against withdrawal from said recess; further including detent means for restraining said keeper means, selectively, in either of said first or second positions; wherein said shaft and said keeper means have mutually engaged keying surfaces formed thereon for causing coincident rotation thereof; and also including operator means, slidably engaged with said keying surfaces of said shaft, for rotating said shaft to cause pivotable movement of said keeper means from either of said first and second positions to the other thereof; wherein said shaft has a bifurcation formed in an end thereof;

said keeper means has an aperture formed therein;

said shaft is in penetration of said aperture; and said keeper means further has tabs formed thereon, extending inwardly of said aperture, which protrude into said shaft between the limbs of said bifurcation.

3. A dogging device according to claim 2, wherein:

said operator comprises a plate having an opening formed therein;

said operator is in surmounting relationship with said keeper means;

said shaft is in penetration of said opening; and said plate has tabs formed thereon, extending inwardly of said opening, which protrude into said shaft between the limbs of said bifurcation.

4. A dogging device, according to claim 2, wherein:

said operator comprises a rod of generally circular cross-section;

said rod having a portion thereof formed with said recesses defining walls parallel with said axis; and said rod is engaged with said shaft, said walls nestably interfacing the limbs of said bifurcation.

5. A dogging device, according to claim 1, wherein:

said keeper means comprises a plate of substanially right-angular configuration; and an end of said plate defines a hook.

6. A dogging device, according to claim 3, wherein:

said plate has a pair of upstanding limbs, the same being disposed for engagement by a rotatable tongue of a locking and unlocking device.

7. A dogging device, according to claim 6, wherein:

said limbs are spaced apart on centers approximately 120 degrees of arc relative to said axis.

8. A dogging device, according to claim 4, wherein:

said rod has a multilateral aperture axially formed therein for receiving a tool.

9. A dogging device, according to claim 8, wherein:

said rod aperture is hexagonal.

10. An adapter kit, for a dogging device for a latching assembly having a translating latching and unlatching control rod; said device having, first means defining a bearing surface; a shaft journaled on its axis in, and extending normal to, said bearing surface; second means, integral with said first means, having a recess formed therein in which to receive an end of a translating, latching and unlatching control rod; keeper means, pivotably mounted on said shaft, for movement between first and second pivotable positions relative to said shaft; wherein said keeper means has means, operative in one of said positions, for engaging an end of a translating latching and unlatching control rod for securing such end against withdrawal from said recess; and further including detent means for restraining said keeper means, selectively, in either of said first or second positions; wherein said shaft and said keeper means have mutually engaged keying surfaces formed thereon for causing coincident rotation thereof; said adapter kit comprising:

a plurality of operator-implements; wherein each of said operator-implements of said plurality thereof has keying surfaces for slidable engagement of the latter with said keying surfaces of said shaft, thereby to couple any one of said operator-implements operably to said shaft to enable rotation of said shaft by said one operator-implement.

11. An adapter kit, for a dogging device, according to claim 10, in which the journaled shaft of the dogging device has means for attaching thereto any one of said operator-implements of said plurality thereof; wherein:

said operator-implements of said plurality thereof each has means cooperative with said shaft attaching means for replaceably engaged attachment thereof to said shaft.

12. An adapter kit, for a dogging device, according to claim 10, in which the journaled shaft of the dogging device has a hole formed therein transverse to the axis thereof, and through at least one of the keying surfaces thereof; wherein:

at least one of said operator-implements has a hole formed through at least one of said keying surfaces thereof; and further including a pin, for slidable penetration of said holes, to secure said one operator-implement keying surfaces to the keying surfaces of the dogging device shaft.

* * * * *